US008752912B1

(12) United States Patent
Johns et al.

(10) Patent No.: US 8,752,912 B1
(45) Date of Patent: Jun. 17, 2014

(54) CARRYING CASE CONVERSION TO DESK

(75) Inventors: Clifford L. Johns, Louisville, KY (US); Munaf Chasmawala, Louisville, KY (US); Dennis McAndrews, Jeffersonville, IN (US); Matthew Laughlin, Louisville, KY (US); Douglas K. Cornett, Louisville, KY (US)

(73) Assignee: Extundo Incorporated, Louisville, KY (US)

( * ) Notice: Subject to any disclaimer, the term of this patent is extended or adjusted under 35 U.S.C. 154(b) by 197 days.

(21) Appl. No.: 13/411,736

(22) Filed: Mar. 5, 2012

Related U.S. Application Data

(60) Provisional application No. 61/451,844, filed on Mar. 11, 2011.

(51) Int. Cl.
*A47B 85/00* (2006.01)

(52) U.S. Cl.
USPC ..... 312/241; 312/281; 312/902

(58) Field of Classification Search
USPC ..... 312/223.3, 296, 240, 241, 244, 277, 312/280–282, 308, 902; 108/50.01, 50.02, 108/14, 62, 69, 90, 155, 158, 158.11, 65; 190/11, 12 R, 18 R, 15.1, 10
See application file for complete search history.

(56) References Cited

U.S. PATENT DOCUMENTS

| | | | | |
|---|---|---|---|---|
| 1,147,077 | A * | 7/1915 | Collier | 312/200 |
| 1,337,178 | A * | 4/1920 | Swerer | 312/283 |
| 2,750,243 | A * | 6/1956 | Zielfeldt | 108/78 |
| 3,156,510 | A * | 11/1964 | Hindin et al. | 312/223.5 |
| 4,966,258 | A * | 10/1990 | Hawley | 190/4 |
| 5,090,562 | A * | 2/1992 | Grullemans | 206/320 |
| 5,485,922 | A * | 1/1996 | Butcher | 206/576 |
| 5,954,408 | A * | 9/1999 | Bogucki | 312/223.3 |
| 6,530,475 | B1 * | 3/2003 | Penney | 206/320 |
| 6,811,006 | B1 * | 11/2004 | Mundle | 190/11 |
| 7,540,560 | B1 * | 6/2009 | Connery | 297/149 |
| 7,819,247 | B2 | 10/2010 | Gonzalez | |
| 7,870,937 | B1 * | 1/2011 | Arnao | 190/1 |
| 2006/0260516 | A1 * | 11/2006 | Chow | 108/14 |
| 2006/0272980 | A1 * | 12/2006 | Montgomery | 206/576 |
| 2007/0145205 | A1 * | 6/2007 | Liang | 248/163.1 |
| 2010/0148645 | A1 * | 6/2010 | Harper | 312/237 |

* cited by examiner

*Primary Examiner* — Janet M Wilkens
(74) *Attorney, Agent, or Firm* — Camoriano and Associates

(57) ABSTRACT

A method for converting a watertight carrying case into a desk that includes mounting a bracket onto rearward projections from the case for permitting the case to serve as a desk without compromising its watertightness.

8 Claims, 13 Drawing Sheets

CARRYING CASE CONVERSION TO DESK

This application claims priority from U.S. Provisional Application Ser. No. 61/451,844 filed Mar. 11, 2011 which is hereby incorporated herein by reference.

BACKGROUND

The present invention relates to a portable desk.

Watertight carrying cases, such as those made by Pelican, are well known, economical, and are used for a variety of industrial needs, such as to carry electronic equipment to a job site. However, it is often very inconvenient to use the electronic equipment at the job site, because the carrying case is placed on the ground and the worker has to get down to ground level in order to use it.

SUMMARY

An embodiment of the present invention provides a carrying case which is adapted to be mounted on a height adjustable stand and which opens up to reveal a compact horizontal desk area which can be used to support electronic equipment, a laptop, or other items.

In one embodiment, a bracket is connected to the exterior of the carrying case using external ribs on the carrying case, which permits a secure mounting of the stand without piercing the body of the case which would adversely affect the watertight integrity of the case.

DESCRIPTION

Figure 1:
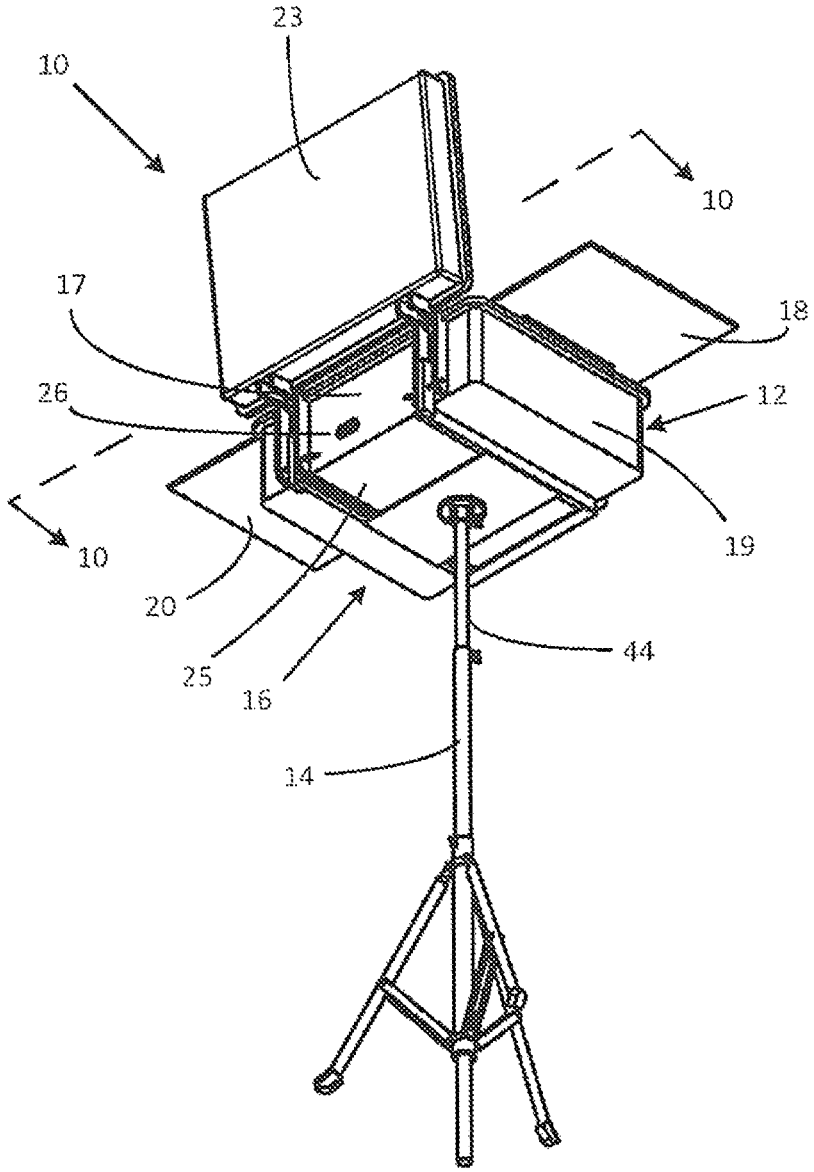
FIG. 1 is a rear perspective view of a carrying case mounted on a stand.
Figure 2:
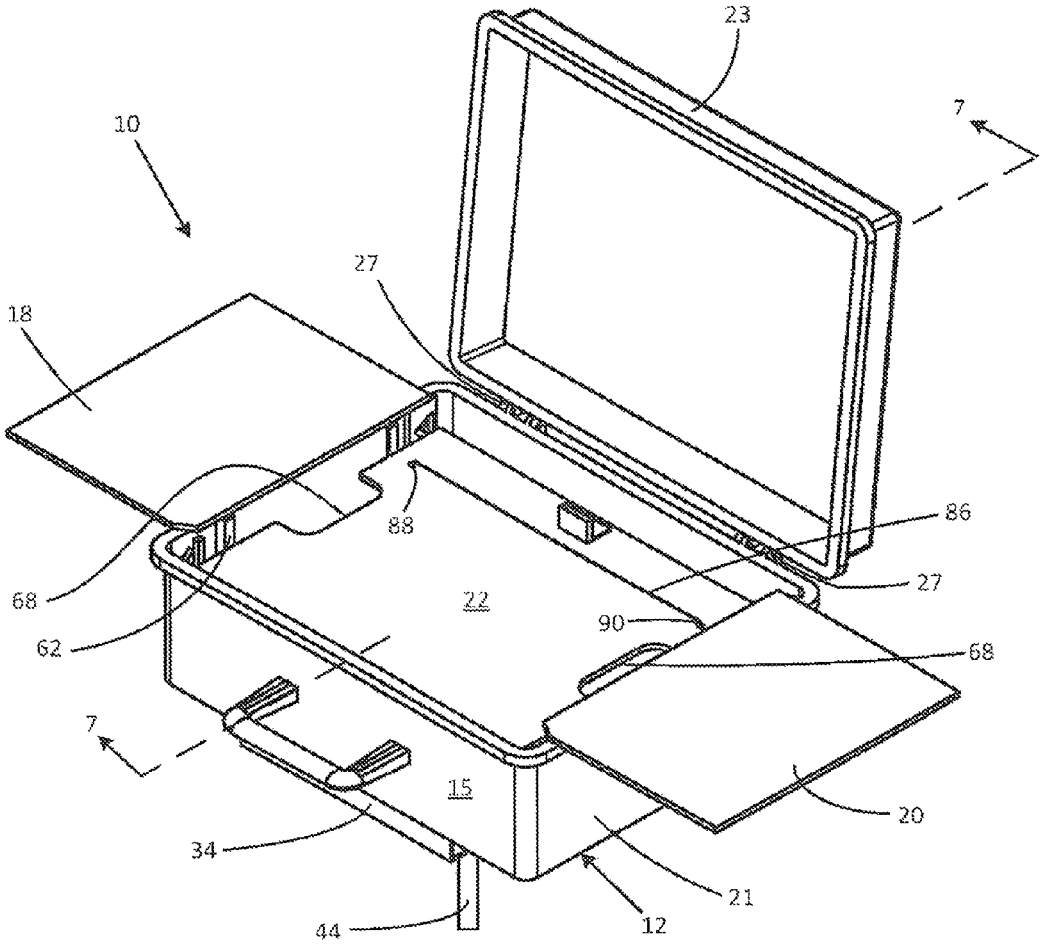
FIG. 2 is a broken away, front perspective view of the case of FIG. 1.

FIGS. 1-13 show a portable desk 10. Referring to FIGS. 1 and 2, the desk 10 includes a carrying case 12, which in this particular embodiment is made by adapting a watertight carrying case manufactured by Pelican Products, Inc. of Torrance, Calif. The case 12 is mounted on a telescoping tripod stand 14 by means of a mounting bracket 16 (See also FIGS. 8 and 9). The adapting kit also includes left and right side plates 18, 20, a support tray 22, a foam insert 24 (See FIG. 5), and an electrical fitting 26 (See FIG. 10), as described in more detail below.

Referring to FIGS. 1 and 2, the case 12 has a front wall 15, a rear wall 17, left and right side walls 19, 21, a top 23, and a bottom wall 25. The top 23 is pivotably connected relative to the bottom 25 by means of hinges 27 located on the rear wall 17.

Figure 8:
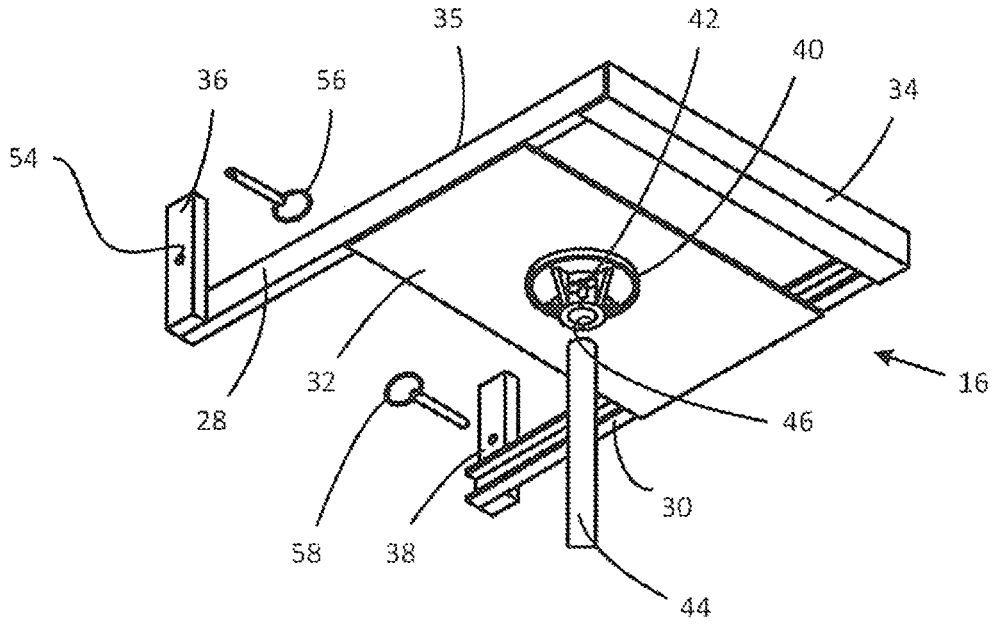
FIG. 8 is a partially exploded, perspective view of the bottom of the mounting bracket of FIG. 1.
Figure 9:
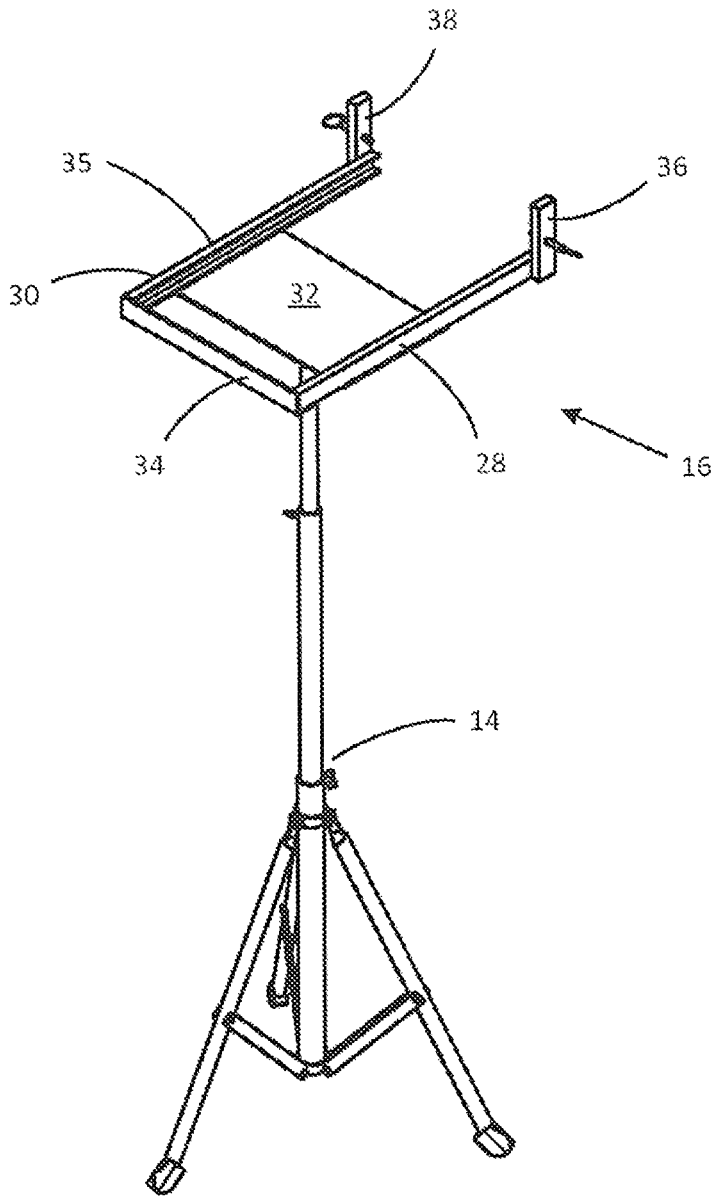
FIG. 9 is a perspective view of the top of the mounting bracket of FIG. 8, mounted on a tripod stand as shown in FIG. 1.

Referring to FIGS. 8 and 9, the mounting bracket 16 is used to releasably secure the case 12 to the mounting stand 14. As will be explained later, the mounting bracket 16 takes advantage of external webs or reinforcing ribs 48, 50 that are part of the originally manufactured case 12 (see FIG. 10) to securely mount the bracket 16 onto the case 12 without piercing the body of the case, so the watertight feature of the case 12 is maintained. For cases with a design which does not include the use of external webs or reinforcing ribs 48, 50 at locations that make it convenient to attach to the mounting bracket 16, a suitable rib can be achieved by attaching a metal or plastic clip (not shown) to the case 12. For example, clips that include projections similar to the ribs 48, 50 on the case shown in FIG. 10 could be adhered to the case.

The bracket 16 has two parallel horizontal arms 28, 30 interconnected by a rectangular mounting plate 32 and an end bar 34 at a first end of the horizontal arms 28, 30 to form a substantially rectangular horizontal mounting surface 35. Two vertical mounting arms 36, 38 project vertically from the second end of the horizontal arms 28, 30, respectively, for securing the mounting bracket 16 to the case 12, as explained below.

The vertical mounting arms 36, 38 are secured to the horizontal arms 28, 30 using two bolts each (not shown). Alternately, the vertical mounting arms 36, 38 can be secured with a single bolt and a pin in each arm 36, 38. The single bolt in each arm 36, 38 is not fully tightened so as to allow the associated vertical mounting arm 36, 38 to rotate and fold down (when the associated pin is removed) to permit a more compact storage of the bracket 16. The pin (not shown) is installed to secure the vertical mounting arms 36, 38 in the vertical position to allow them to be attached to a reinforcing rib 48, 50 or clip (not shown). The folding feature of the bracket 16 allows it to fit inside the case 12 for storage and transportation The tripod stand 14 can be attached to a clamp, not shown, mounted on one of the available surfaces of the case 12 for the purposes of transportation and storage.

As shown in FIG. 8, a flange 40 is bolted to the bottom side of the plate 32. The flange 40 supports a projection that defines a cylindrical recess 46 having a vertical axis (perpendicular to the plate 32). A wing nut thumbscrew 42 is threaded into the wall of the projection and can be threaded through, into the cylindrical recess 46, in order to tighten onto a post 44 that is received in the recess 46. The thickness or strength of plate 32 is chosen to ensure it can support the total weight of the case 12 and any of its contents. The plate 32 may be stiffened by adding a gusset (not shown) across the plate 32 and connected to the horizontal arms 28, 30.

As best appreciated in FIGS. 1 and 8, the vertical post 44 of the telescoping tripod stand 14 is received in the cylindrical recess 46 of the bolted flange 40. The wing nut thumbscrew 42 is threaded in to secure the mounting plate 32 to the tripod stand 14, as shown in FIG. 8. It should be noted that other types of support stands using a vertical post 44 could be substituted for the tripod stand 14, if desired.

Figures 13A, 13B, 13C, 13D, 13E:
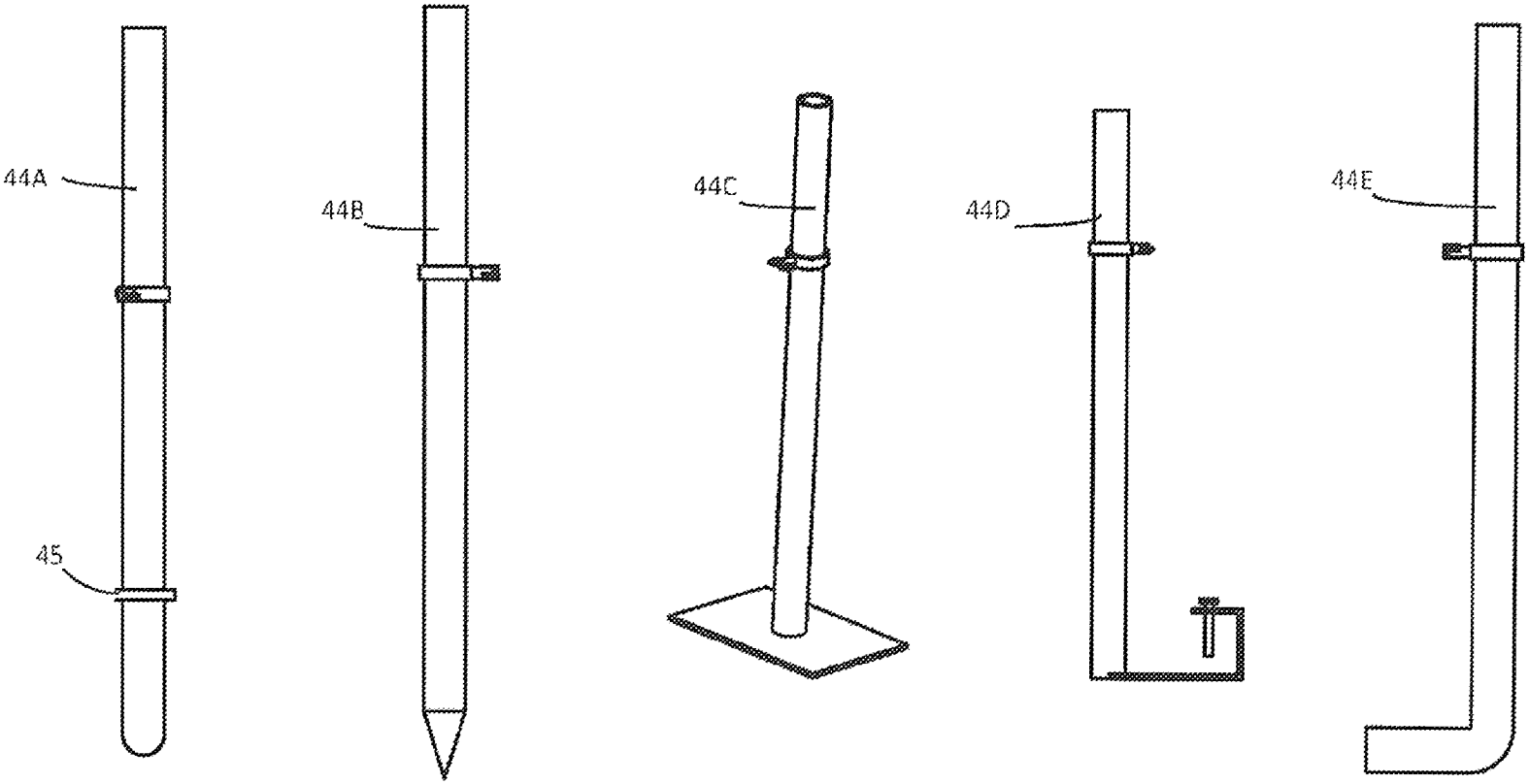
FIG. 13A is a front view of an alternative mounting post.
FIG. 13B is a front view of another alternative mounting post.
FIG. 13C is a front view of still another alternative mounting post.
FIG. 13D is a front view of yet another alternative mounting post.
FIG. 13E is a front view of still another alternative mounting post.

For example, if the product is to be used on the top tubesheet of a chemical reactor or other vertical tube heat exchanger having a plurality of tubes, then the telescoping vertical post 44A of FIG. 13A could be used. That vertical post 44A has a diameter that allows it to fit into the vertical tube of the heat exchanger (not shown), and, a few inches from its lower end, it has a flange 45 that is larger than the inside diameter of the heat exchanger tube, which serves as a stop to prevent the post 44A from going further into the reactor tube.

FIG. 13B shows a vertical post 44B with a sharply pointed bottom that allows it to be inserted into the ground. FIG. 13C shows a vertical post 44C with a flat horizontal plate welded to the bottom. That flat plate could rest on the floor or the ground, and sandbags could be placed on top of it to provide greater stability, if desired. FIG. 13D shows a vertical post 44D that includes a C-clamp for clamping to a shelf or other projection that might be available. FIG. 13E shows a vertical post 44E that is welded to a horizontal projection having a square cross-section that is sized to be received in the receptacle of a trailer hitch. Any of these alternatives could be received in the cylindrical recess 46 of the bracket 16. Furthermore, any of these alternative vertical posts 44 can be secured to the tripod stand 14 using a clamp or an elastic cord (not shown).

Referring now to FIGS. 1, 8, 9, and 10, the case 12 is set down onto the two horizontal arms 28, 30 of the mounting bracket 16, with the vertical mounting arms 36, 38 projecting upwardly into the spaces defined between respective pairs of reinforcing webs 48, 50 of the case 12. As best seen in FIG. 11, horizontal through openings 52 have been drilled through the vertical inner webs 50, and these openings 52 are aligned with respective through openings 54 (See FIG. 8) in the respective vertical mounting arms 36, 38. Quick release pins 56, 58 are inserted through the aligned sets of openings 52, 54 to releasably secure the case 12 to the mounting bracket 16.

Figure 10:
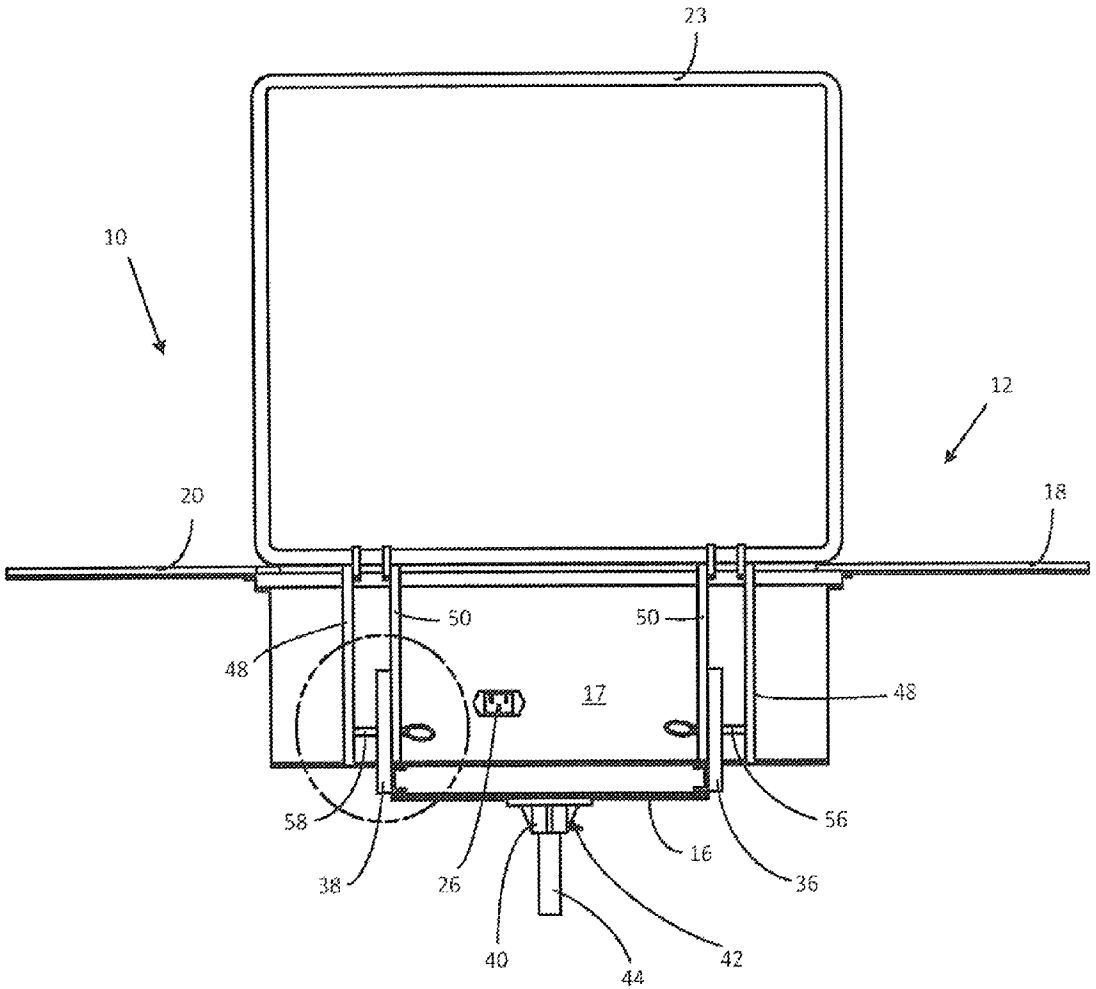
FIG. 10 is a view along line 10-10 of FIG. 1 with the tripod stand omitted for clarity.
Figure 11:
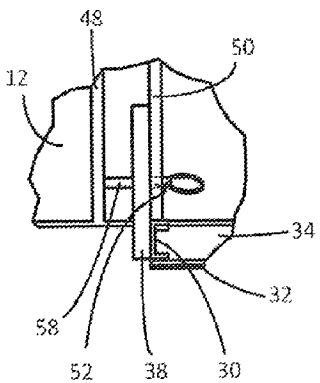
FIG. 11 is an enlarged, broken-away view of the lower left portion of FIG. 10.

Referring to FIG. 10, this embodiment includes a watertight electrical fitting 26, which has been installed on the rear wall 17 of the case 12. Electrical items inside the case 12, such as a laptop, a printer, an external hard drive, controllers, or any other items, can be plugged into this electrical fitting 26 on the inside of the case 12. Once in the field, a power supply source, such as an extension cord (not shown), is plugged into the electrical fitting 26 on the outside of the case 12 in order to power up any items that are plugged into the fitting 26 on the inside of the case 12. Note that the electrical fitting 26 is advantageously located on the rear wall of the case 10, and projects rearwardly a shorter distance than the webs 48, 50, so it is protected by the reinforcing webs 48, 50 even when the case 12 is set on the ground resting on the webs 48, 50. Other watertight and ruggedized connectors with covers (not shown) can be located on the rear 17 or on the sides 19, 21 of the case 12.

Figure 3:
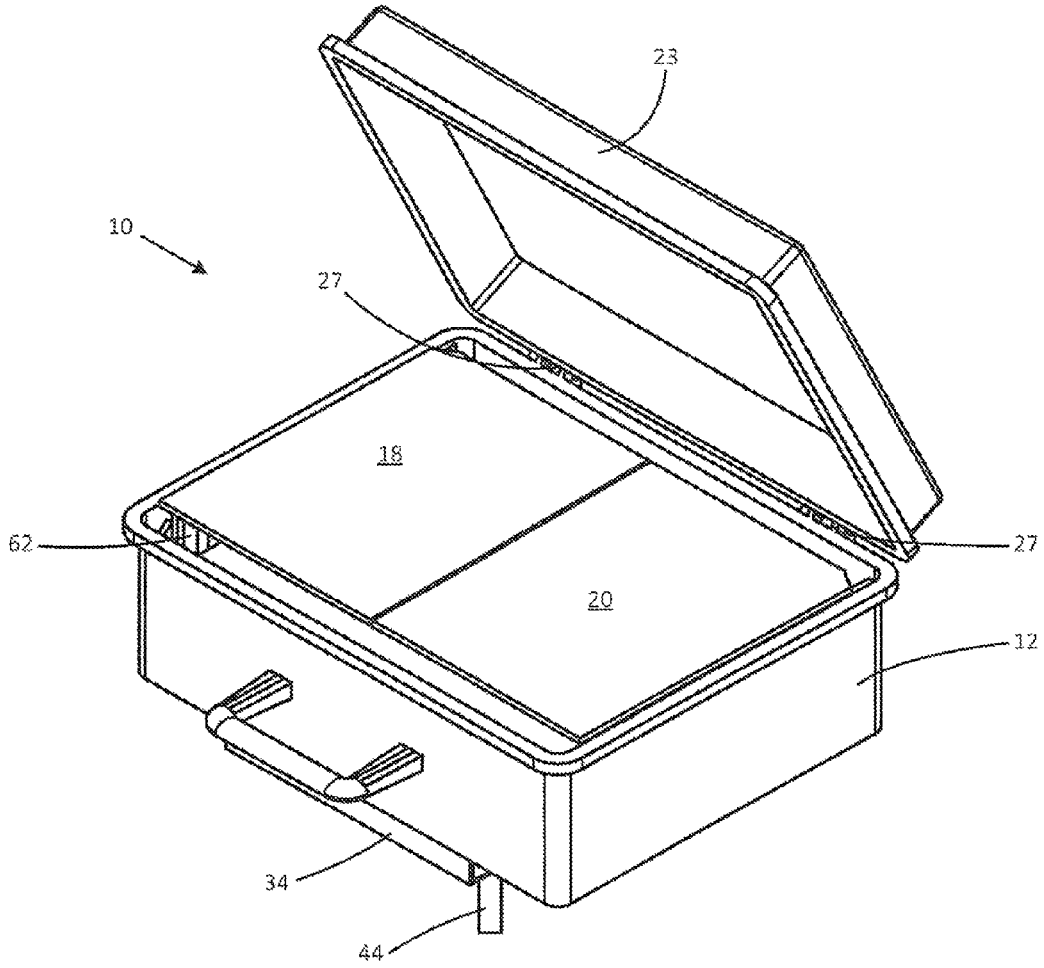
FIG. 3 is broken away, front perspective view of the case of FIG. 2 when the case is initially opened, with the side plates still in the stowed configuration.
Figure 4:
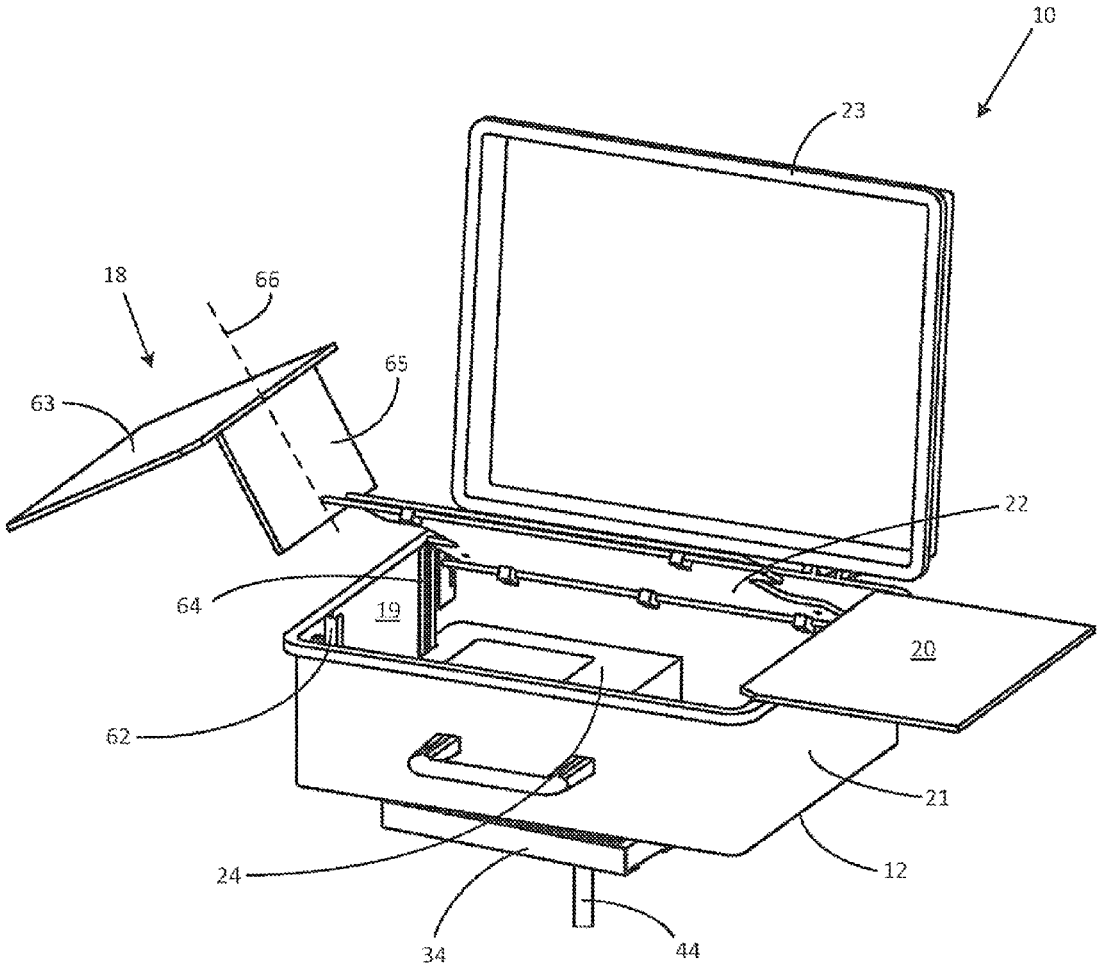
FIG. 4 is a broken away, front perspective view of the case of FIG. 3 with the left side plate being installed in the deployed configuration and the right side plate already in its deployed configuration.

Referring to FIGS. 2 and 4, the desk 10 includes two side plates 18, 20, which are shown in the deployed position in FIG. 2 and in the stowed position in FIG. 3. When in the stowed position, the side plates 18, 20 help secure and protect the contents of the case 12, which are located beneath the plates 18, 20. When deployed, as shown in FIG. 2, the side plates 18, 20 extend outwardly to the sides of the open case 12 and may be used as work surfaces such as for a mouse for a laptop or for holding papers or other documents (not shown). Clips such as the hinged clips used on a clipboard, may be added to the side plates 18, 20 to assist in holding the papers onto the side plates 18, 20. Of course, the side plates 18, 20 may be custom designed to meet specific needs. For instance, instead of two side plates 18, 20, a single plate could be used which extends the full width of the case 12 (or any portion thereof), or the side plates may be omitted entirely if they are not needed, or if space or weight is an issue.

Figure 7:
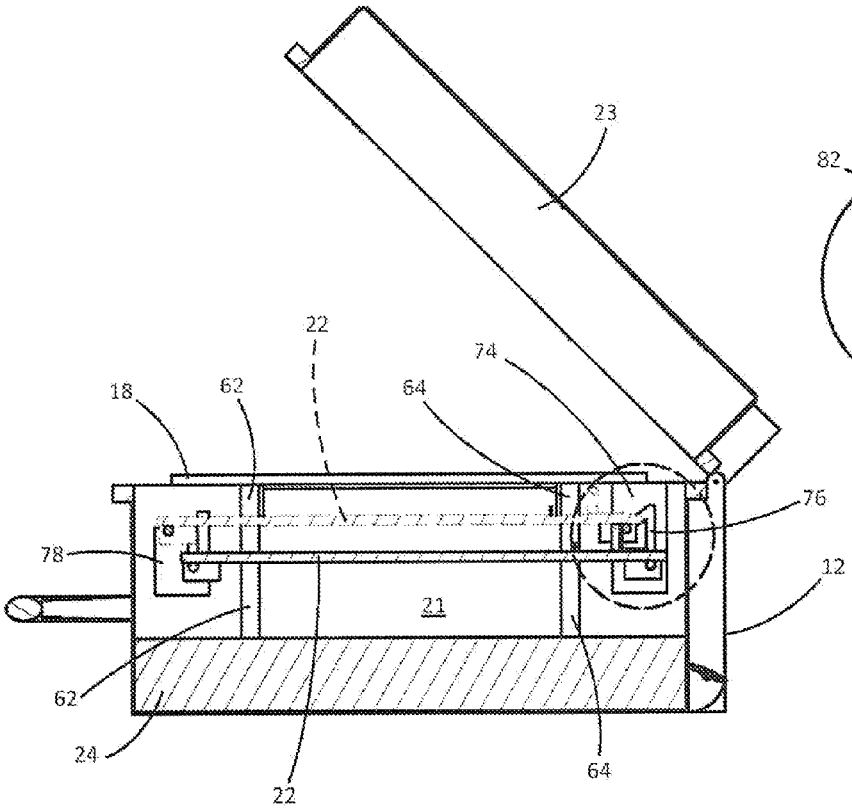
FIG. 7 is a section view along line 7-7 of FIG. 2.

FIGS. 4 and 7 show "C" channels 62, 64 which are secured to the interior of the left side wall 19 of the case 12, and which are used to guide and releasably hold the side plates 18, 20 in place, either in the stowed or in the deployed positions. (The same arrangement is on the interior of the right side wall 21, with the channels on the right side wall lying directly opposite the corresponding channels on the left side wall). As shown in FIG. 4, the plate 18 includes both a substantially flat horizontal plate or wing 63 and a second, substantially flat vertical plate 65 intersecting and secured to the horizontal plate 63 at one edge of the horizontal plate 63. To remove or install the plate 18, the user simply lifts the plate 18 such that the vertical plate 65 slides along the "C" channels 62, 64; up for removing the plate 18, or down for installing the plate 18. The orientation of the horizontal plate 63 relative to the case 12 dictates whether the wing 63 projects inwardly (is stowed) or projects outwardly (is deployed). Lifting the plate 18, rotating it 180 degrees about the axis 66 (See FIG. 4) and lowering it back into the "C" channels 62, 64, changes the orientation of the plate 18 from the stowed position to the deployed position and vice versa. As shown in FIGS. 2 and 3, the above explanation for the plate 18 is also applicable to the plate 20, located on the right side wall 21.

Many cases have tapered left and right side walls 19. 21, which are not exactly vertical when the bottom wall 25 is horizontal but instead are tapered outwardly slightly so that the left-to-right width of the case 12 is greater at the open edge than at the bottom wall 25. In that case, the vertical plate 65 and horizontal plate 63 are not exactly 90 degrees from each other. Instead, the angle is selected so that, when the vertical plate 65 is parallel to the respective left or right side wall 19. 21, the horizontal plate 63 will be horizontal (parallel to the bottom wall 25) when the horizontal plate 63 is projecting outwardly (in the position shown in FIG. 4.) Of course, that means that, when the side plates are rotated 180 degrees and are again inserted into the C-channels 62, with the horizontal plates 63 projecting inwardly, the horizontal plates 63 are canted slightly upwardly. The space below the inwardly-projecting horizontal plates 63 may be used to store a laptop or other equipment to float, with the rigid plates 63 providing protection for that equipment if the lid of the case were to become crushed. The plates 63 also provide a preload for items stored in the lid to prevent them from shifting when the case is closed and being moved.

Figure 5:
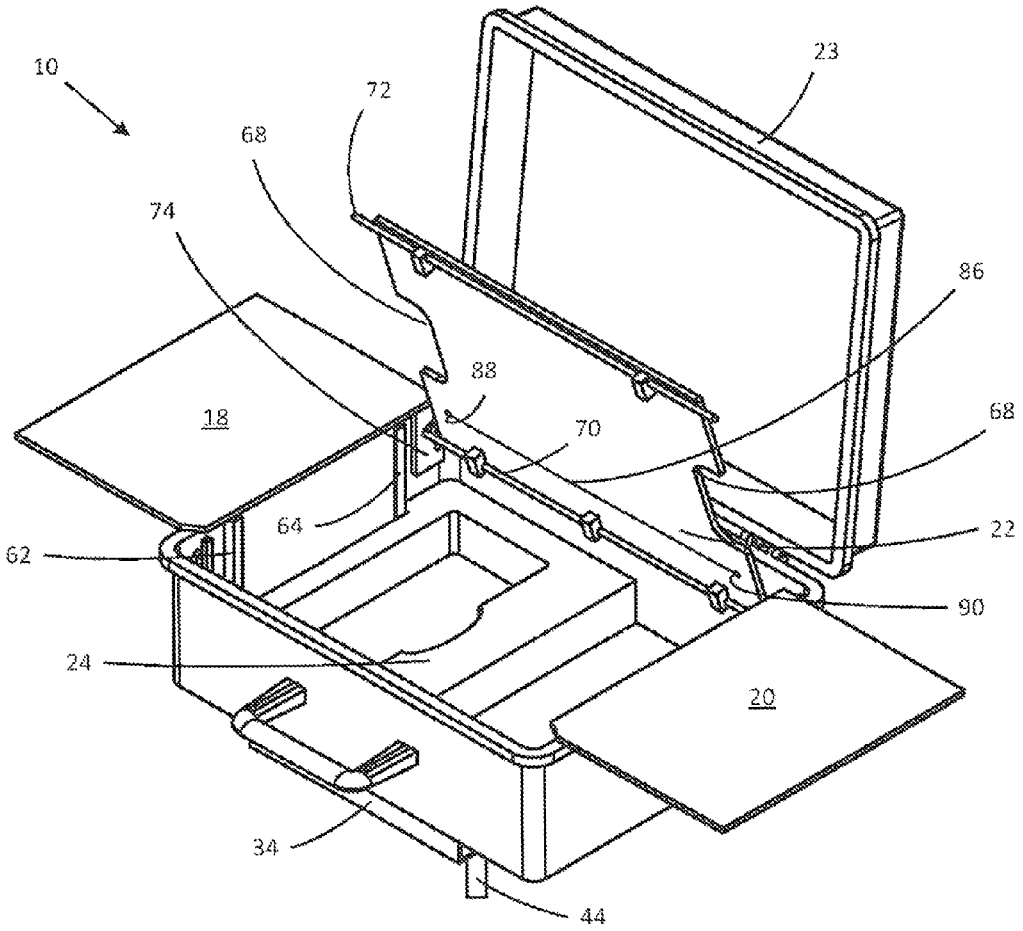
FIG. 5 is a broken away, front perspective view of the case of FIG. 4 with the laptop tray in its hinged-wide-open position.

Referring now to FIGS. 2, 4, and 5, the support tray 22 is a substantially flat plate 22 defining "U" shaped recesses 68 on the left and right sides to enable a user to reach behind the plate 22 to pull the support tray 22 up from its stowed position (shown in FIG. 7) to its deployed position (shown in FIG. 2 and in phantom in FIG. 7), as explained below.

Referring briefly to FIG. 5, there are two rods 70, 72 extending the full width, and just beyond the side edges, of the plate 22. These rods 70, 72 are fastened to the bottom of the plate 22 near the front and rear edges respectively of the plate 22. The rear rod 70 cooperates with rear brackets 74 secured to the side walls of the case 12 to provide both a height adjustment function and a pivotable support "hinge" function to the support tray 22, as explained later.

Figure 12:
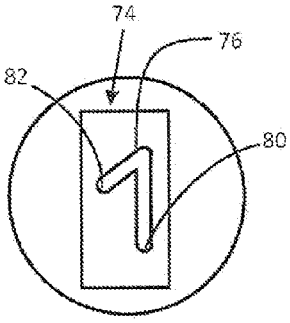
FIG. 12 is an enlarged view of the bracket of FIG. 7.

FIGS. 7 and 12 show one of the rear brackets 74, which is a solid plate with an inverted, "J"-shaped groove 76 cut into the plate. Similarly shaped front brackets 78 are secured to the side walls of the case 12 and cooperate with the front rod 72 to provide a height adjustment function to the support tray 22. It may be appreciated that the front brackets 78 have the same inverted "J"-shaped groove 76 of the rear brackets 74, but the top portion of the bracket has been omitted, which allows the rod 72 (and therefore also the support tray 22) to be lifted up and away from the front brackets 78, as shown in FIGS. 4 and 5. The bottom 80 of the grooves 76 (See FIG. 12) in the brackets 74, 78 provide the stops for the rods 70, 72, respectively, to support the support tray 22 in the lower, or stowed, position. The opposite end 82 of the grooves 76 in the brackets 74, 78 provide the stops for the rods 70, 72 respectively to support the support tray 22 in the upper, or deployed, position (as shown in phantom in FIG. 7).

This support plate 22, as shown in these figures, is substantially coplanar to the bottom portion 25 of the case 12 whether the plate 22 is in its lowered (stowed) position or in its upper (deployed position). When in the deployed position, the front of the support tray 22 may be pivoted upwardly, as shown in FIGS. 4 and 5, as there is no upper portion of the front brackets 78 to prevent the front rod 72 from clearing the front brackets 78. The rear rod 70, on the other hand, is "trapped" in the groove 76 of the rear brackets 74, such that the rear brackets 74 and the rear rod 72 together function as a pivotable hinge support for the support tray 22. The user may reach behind the support tray 22 when it is in its lowered, stowed position by reaching through the "U"-shaped recesses 68 and raising the support tray 22 to its upper, deployed position.

When in the deployed position, the support tray 22, shown in phantom in FIG. 7, allows for air to circulate freely underneath the plate 22 so as to allow the circulating air to cool and devices which may be stowed inside the case 12, including heat generating devices, such as power supplies.

FIGS. 2 and 5 help illustrate how a laptop (not shown) may be secured to the support tray 22. With the laptop resting on the support tray 22, a wire or cable 86 extends across the laptop 84 at or near the intersection of the keyboard with the monitor. This same wire 86 is fed through small openings 88, 90 in the support tray 22 and then the ends of the wire 86 are secured together on the back side of the support tray 22. Of course, this is but one example of how a laptop could be secured to the support tray 22. Other options may include the use of Velcro™ (hook and loop) fasteners, for instance. Of course, other items may be supported on or secured to the support tray 22 instead of, or in addition to, a laptop.

Figure 6:
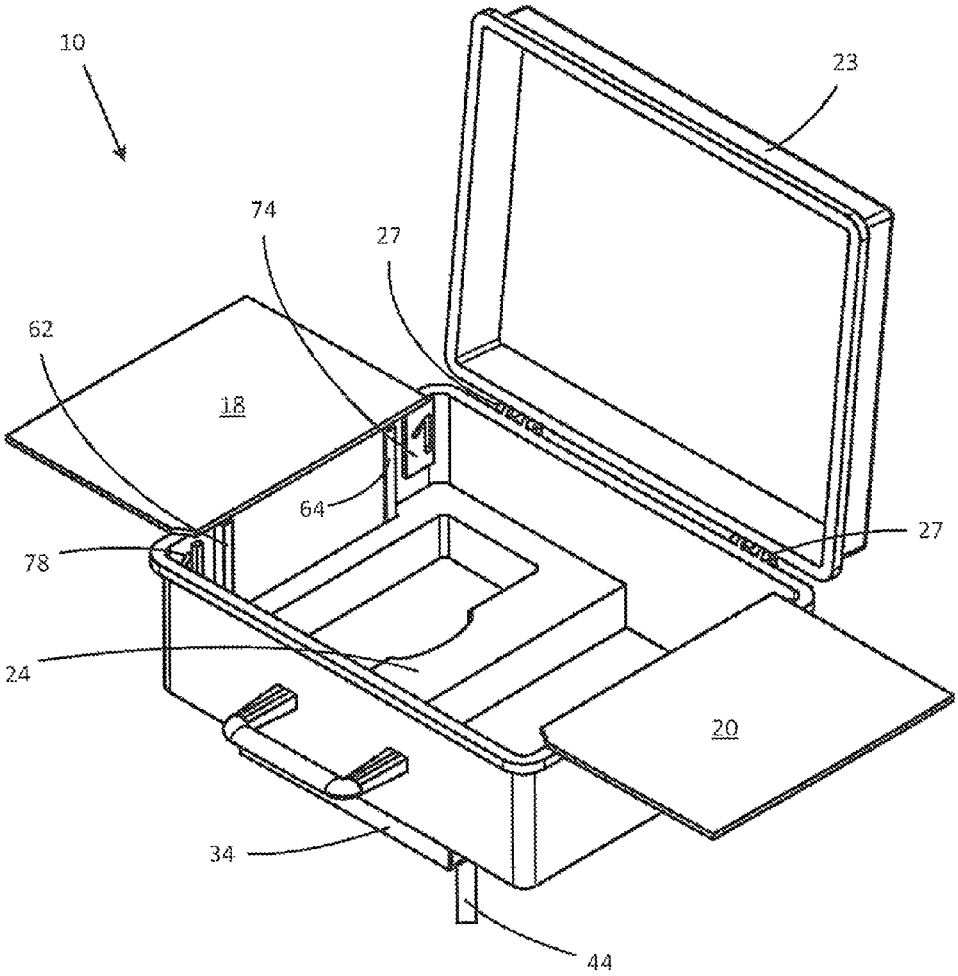
FIG. 6 is a broken away, front perspective view of the case of FIG. 5 with the laptop tray totally removed for complete access to the storage area under the tray.

FIGS. 5 and 6 show a foam insert 24 which may be used to accommodate and protect any number of accessories, such as a portable printer (not shown), battery chargers 94 (not shown), and electrical switch boxes 96 (not shown). These accessories are stowed in the case 12, in the space under the support tray 22 when the support tray 22 is in its lower, stowed, position. Any and all of the accessories, as well as the laptop computer may be prewired to the electrical fitting 26 (See FIG. 10) inside the case 12. When the desk 10 is to be used, an external power source, such as an extension cord, may be plugged into the electrical fitting 26 on the outside of the case 12 to power up all the devices already plugged into the same electrical fitting 26 inside the case 12.

In one embodiment, a plug-in 28 Volt power supply and a voltage converter are provided inside the case 12. In this instance a low voltage power source is all that is needed to plug into the outlet 26 to power the 28 Volt power supply. This power supply and the voltage converter are then used to power the other accessories inside the case 12, such as the printer and the computer.

It should be noted that any openings drilled into the case 12 to fasten brackets, electrical fittings, or any other accessories, may be done so as to retain the watertight quality of the case 12. For instance, they may be mounted using silicone sealant, or with properly applied O-Rings, in order to prevent water migration into the case 12.

Alternatively, it may be desirable not to pierce the shell of the case 12 at all, in order to maintain its original watertight status. In that case, any internal brackets may be adhered to the inner wall of the case 12, if desired, secured in some other way, such as by VHB adhesive tape available from 3M, or omitted altogether. As was explained earlier, the external mounting brackets do not pierce the shell of the case 12.

Figure 14:
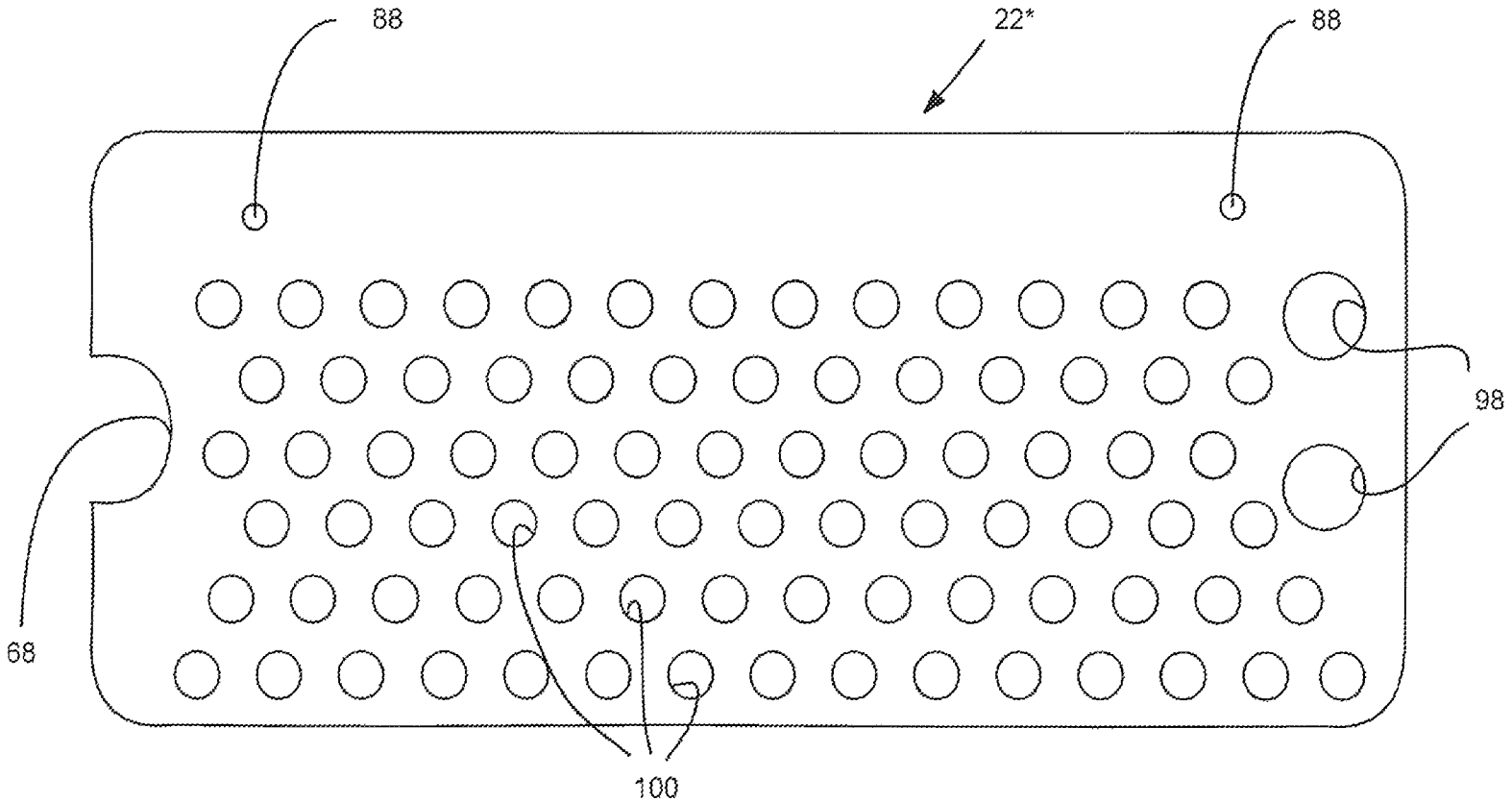
FIG. 14 is a plan view of an alternate embodiment of a support tray for the case of FIG. 2.

FIG. 14 is a plan view of an alternate support tray 22* which may be used in the case 12 of FIGS. 2, 4, and 5. The main difference between this tray 22* and the original tray 22 is that is has only one of the "U"-shaped recesses 68 to provide access to lift the tray 22 to its deployed position. On the opposite end of the tray 22, a couple of through openings 98 provide access for the user to insert his fingers to assist in lifting the tray 22. Smaller through openings 100 provide ventilation through the tray 22 while at the same time reducing the overall weight of the tray 22.

Figure 15:
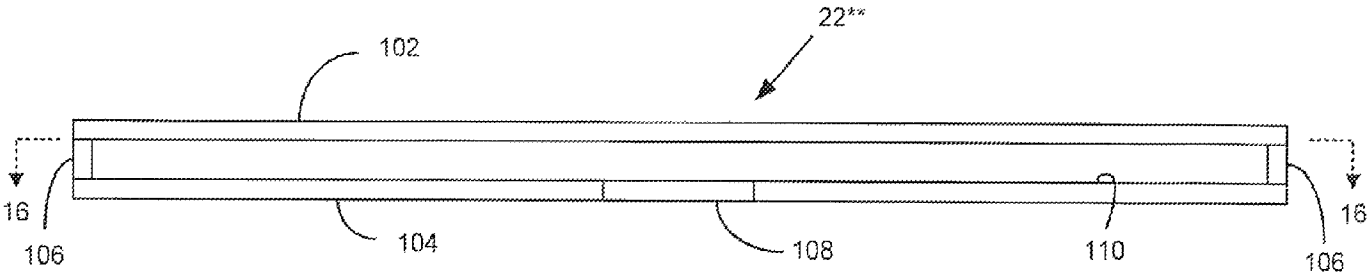
FIG. 15 is a side view of another embodiment of a support tray for the case of FIG. 2.
Figure 16:
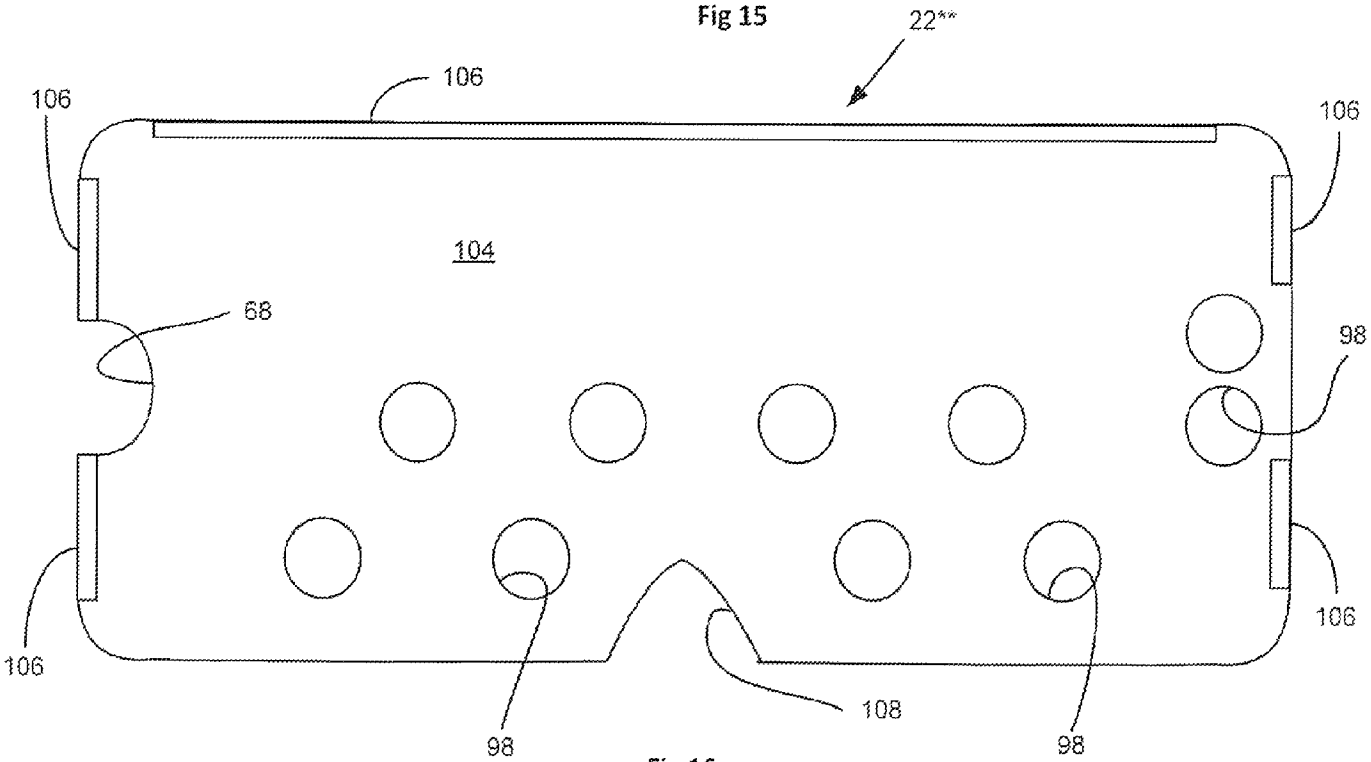
FIG. 16 is a view along line 16-16 of FIG. 15.

FIGS. 15 and 16 show another alternative embodiment of a support tray 22 which may be used in the case 12 of FIGS. 2, 4, and 5. The main difference between this tray 22** and the tray 22* described above is that is has an upper plate 102 and a lower plate 104 which are joined together by a plurality of side spacers 106 which are present only in the rear and sides of the tray 22**. The upper and lower plates 102, 104 form an elongated cavity 110, with an open access on the front side, for storage of supplies, such as printer paper. A recess 108 along the front side of the tray 22** facilitates the removal of one or more sheets of paper from the cavity 110. A plurality of openings 98 provide access for the fingers of a user to reach into the cavity 110 to help slide out any papers or other supplies which may be stowed in the tray 22****.

While the embodiment described above shows a simple means for adjusting the height of the case 12 and the height of the support tray 22 in the case 12, various other mechanisms, including for instance a foot operated pneumatic pump, could be used to adjust these heights, and various known mechanisms could be used to mount accessories to the support tray 22. It will be obvious to those skilled in the art that modifications may be made to the embodiments described above.

What is claimed is:

1. A method for converting a watertight carrying case into a portable desk, comprising the steps of:

using a carrying case having a body with a horizontal bottom side;

front, rear, left and right sides projecting upwardly from said bottom side; and a horizontal top lid pivotably connected to said body for opening and closing said carrying case, wherein each of said sides and top lid has an interior surface and an exterior surface;

wherein the exterior surface of said rear side defines first and second spaced-apart projections extending rearwardly, each of said first and second spaced-apart projections having an outer surface; and wherein said top lid portion pivots relative to the body from a closed position, in which the interior surfaces of the bottom, front, rear, left and right sides and top lid define a watertight interior compartment, to an open position, in which the interior surfaces are exposed; and mounting a mounting bracket on the exterior surface of said case without piercing through any interior surface of the case so as to keep the interior compartment watertight when the case is in the closed position, said step of mounting said mounting bracket including extending first and second mounting portions of said mounting bracket along the outer surfaces of said first and second spaced-apart projections, respectively, forming horizontally-oriented openings through the first and second spaced-apart projections; and extending a fastener through a horizontally-oriented opening that has been formed in the first projection and through a corresponding horizontally-oriented opening in the first mounting portion and extending a fastener through another horizontally-oriented opening that has been formed in the second projection and through a corresponding horizontally-oriented opening in the second mounting portion to secure the mounting bracket to the case.

2. A method for converting a watertight carrying case into a portable desk as recited in claim 1, and further comprising the steps of:

providing a support stand;

fixing the support stand relative to the ground; and mounting the support stand to the mounting bracket to support the carrying case with the bottom side oriented horizontally when the support stand is fixed relative to the ground.

3. A method for converting a watertight carrying case into a portable desk as recited in claim 2, and further comprising the step of inserting a vertical portion of an L-shaped side plate having a horizontal portion and a vertical portion into a space defined by opposed, parallel interior channels on said body.

4. A method for converting a watertight carrying case into a portable desk as recited in claim 3, wherein the vertical portion of the L-shaped side plate can be inserted into said opposed, parallel interior channels in a first orientation, with the horizontal portion of the side plate extending outwardly, and in a second orientation, with the horizontal portion of the side plate extending inwardly so that the horizontal portion lies entirely inside said watertight interior compartment.

5. A method for converting a watertight carrying case into a portable desk as recited in claim 4, including mounting two of said L-shaped side plates on said body, one adjacent to the left side and the other adjacent to the right side of said body.

6. A method for converting a watertight carrying case into a portable desk as recited in claim 1, and further comprising the step of mounting an electrical outlet on the outer surface of said body which is sealed against the body and is in electrical communication with the interior cavity so as to keep the interior compartment watertight when said top lid is in the closed position.

7. A portable desk, comprising:

a carrying case having a body with a horizontal bottom side;

front, rear, left and right sides projecting upwardly from said bottom side; and a horizontal top lid pivotably connected to said body for opening and closing said carrying case, wherein each of said sides and top lid has an interior surface and an exterior surface;

wherein the exterior surface of said rear side defines first and second spaced-apart projections extending rearwardly; and wherein said top lid portion pivots relative to the body from a closed position, in which the interior surfaces of the bottom, front, rear, left and right sides and top lid define a watertight interior compartment, to an open position, in which the interior surfaces are exposed; and a mounting bracket mounted on the exterior surface of said case without piercing through any interior surface of the case so as to keep the interior compartment watertight when the case is in the closed position, said mounting bracket including mounting portions lying adjacent to the projections, and further comprising a plurality of fasteners, each of said fasteners extending through a horizontally-oriented opening in one of the projections and through a corresponding horizontally-oriented opening in one of said mounting portions to secure the mounting bracket to the case;

and further comprising:

a support stand;

means for fixing the support stand relative to the ground; and means for mounting the support stand to the mounting bracket to support the carrying case with the bottom side oriented horizontally when the support stand is fixed relative to the ground;

and further comprising an L-shaped side plate having a horizontal portion and a vertical portion; wherein said body defines opposed, parallel interior channels which receive and support the vertical portion of the L-shaped side plate; wherein the vertical portion of the L-shaped side plate can be inserted into said opposed, parallel interior channels in a first orientation, with the horizontal portion of the side plate extending outwardly, and in a second orientation, with the horizontal portion of the side plate extending inwardly so that the horizontal portion lies entirely inside said watertight interior compartment; and wherein there are two of said L-shaped side plates mounted on said body, one being mounted adjacent to the left side and the other being mounted adjacent to the right side of said body;

and further comprising a support tray defining a support surface; and means for securing said support tray inside said body in three different positions, a first position in which the support surface is at a first height parallel to the bottom of the body, a second position in which the support surface is at a second height parallel to the bottom of the body, and a third position in which the support surface is perpendicular to the bottom of the body.

8. A portable desk as recited in claim 7, wherein said support tray defines an upper plate and a lower plate and at least one spacer separating said upper plate from said lower plate to form an elongated cavity between said upper and lower plates.

* * * * *